US009487999B2

(12) United States Patent
Seuberling et al.

(10) Patent No.: US 9,487,999 B2
(45) Date of Patent: Nov. 8, 2016

(54) GAZEBO SCREEN INSTALLATION SYSTEM

(71) Applicant: Home Improvement Systems, Inc., Cincinnati, IN (US)

(72) Inventors: David Seuberling, Cincinnati, OH (US); Michael Tompkins, Cherryville, NC (US)

(73) Assignee: Home Improvement Systems, Inc., Cincinnati, OH (US)

( * ) Notice: Subject to any disclaimer, the term of this patent is extended or adjusted under 35 U.S.C. 154(b) by 0 days.

(21) Appl. No.: 14/744,560

(22) Filed: Jun. 19, 2015

(65) Prior Publication Data

US 2016/0040477 A1 Feb. 11, 2016

Related U.S. Application Data

(63) Continuation-in-part of application No. 14/451,849, filed on Aug. 5, 2014.

(51) Int. Cl.
*E06B 9/52* (2006.01)
*E04H 1/12* (2006.01)

(52) U.S. Cl.
CPC ..... *E06B 9/52* (2013.01); *E04H 1/1205* (2013.01); *E06B 2009/527* (2013.01)

(58) Field of Classification Search
CPC ..... E06B 9/52; E06B 3/48; E06B 7/00; E06B 9/00
USPC ..... 52/204.53, 204.54, 63, 222, 656.7; 160/380, 381, 382, 395, 403
See application file for complete search history.

(56) References Cited

U.S. PATENT DOCUMENTS

| | | | | |
|---|---|---|---|---|
| 918,676 | A | 4/1909 | Johnson | |
| 1,586,708 | A | 6/1926 | Sandelin | |
| 3,469,695 | A | 9/1969 | Greeninger | |
| 3,696,857 | A | 10/1972 | Tarte | |
| 3,960,197 | A * | 6/1976 | Daniels | B41F 15/36 160/371 |
| 3,980,555 | A | 9/1976 | Freissle | |
| 4,189,880 | A | 2/1980 | Ballin | |
| 4,234,035 | A | 11/1980 | Babbs | |
| 4,333,284 | A | 6/1982 | Meadows | |
| 4,658,522 | A | 4/1987 | Kramer | |
| 4,690,192 | A | 9/1987 | Stilling | |
| 5,666,773 | A | 9/1997 | Librande et al. | |
| 5,904,200 | A | 5/1999 | Agen | |
| 6,032,433 | A | 3/2000 | Hatziathanasiou | |
| 6,378,267 | B1 | 4/2002 | Bass | |

* cited by examiner

*Primary Examiner* — William Gilbert
(74) *Attorney, Agent, or Firm* — Indiano & Mcconnell LLC

(57) ABSTRACT

A gazebo screen installation system is disclosed that is operable to allow screen frame assemblies to be installed in gazebos. The system includes a gazebo screen frame having a wedge portion and a trim portion. The trim portion includes a mounting rib extending upwardly from an upper surface of the trim portion and the wedge portion extends downwardly from said trim portion. A backing wedge strip is included having an angled surface and a mounting surface. The angled surface is formed in relation to the mounting surface such that a right angle forming angle is created in relation to a screen material when the backing wedge strip is connected with a vertical support member of a gazebo.

18 Claims, 18 Drawing Sheets

GAZEBO SCREEN INSTALLATION SYSTEM

CROSS REFERENCE TO RELATED APPLICATION

The present application is a continuation-in-part of and claims priority to U.S. patent application Ser. No. 14/451,849 filed on Aug. 5, 2014 and entitled Plinth For Window Screen Installation System.

BACKGROUND

It is well known that most screens manufactured today include a replaceable screen fabric. In the event the fabric is torn, stretched, or otherwise damaged, the fabric is removed and replaced with another such fabric. Typically this task is accomplished by removing a gasket-type device from within a recess formed around the perimeter of a frame. The gasket retains the fabric edges within the recess such that when the gasket is removed, the fabric is likewise removed. A new fabric is then stretched across the frame and the gasket is replaced within the recess. Excess fabric along the perimeter of the screen—and specifically that material along the perimeter of the fabric and on the side away from the gasket—is then trimmed.

Although this is a simplistic procedure to describe, it is well known that stretching the fabric and maintaining it in a stretched manner while the gasket is replaced is a difficult task. What typically occurs when the appropriate tools are not available is that as the gasket is forced into place, the fabric loosens or is pulled in a direction such as to create wrinkles. Further, due to the tension on the fabric during installation, it is often difficult to force the gasket into the recess without damaging the fabric, or without releasing the tension on the fabric.

One such solution to this problem can be found in U.S. Pat. No. 6,378,267 to Bass, which has been assigned to the applicant. As the system disclosed in the '267 Patent has been used, it has become apparent that a need exists for a way in which to allow the installer to cut the ends of the frames and trim molds square instead of mitered which creates a gap between the ends of the two frame pieces once installed. The gap between the ends of the mitered frame pieces is not aesthetically appealing. Further, this manner of mating the two frame pieces together does not provide any manner of further securing the trim molds to the frames.

DESCRIPTION OF ILLUSTRATIVE EMBODIMENTS

Figure 1:
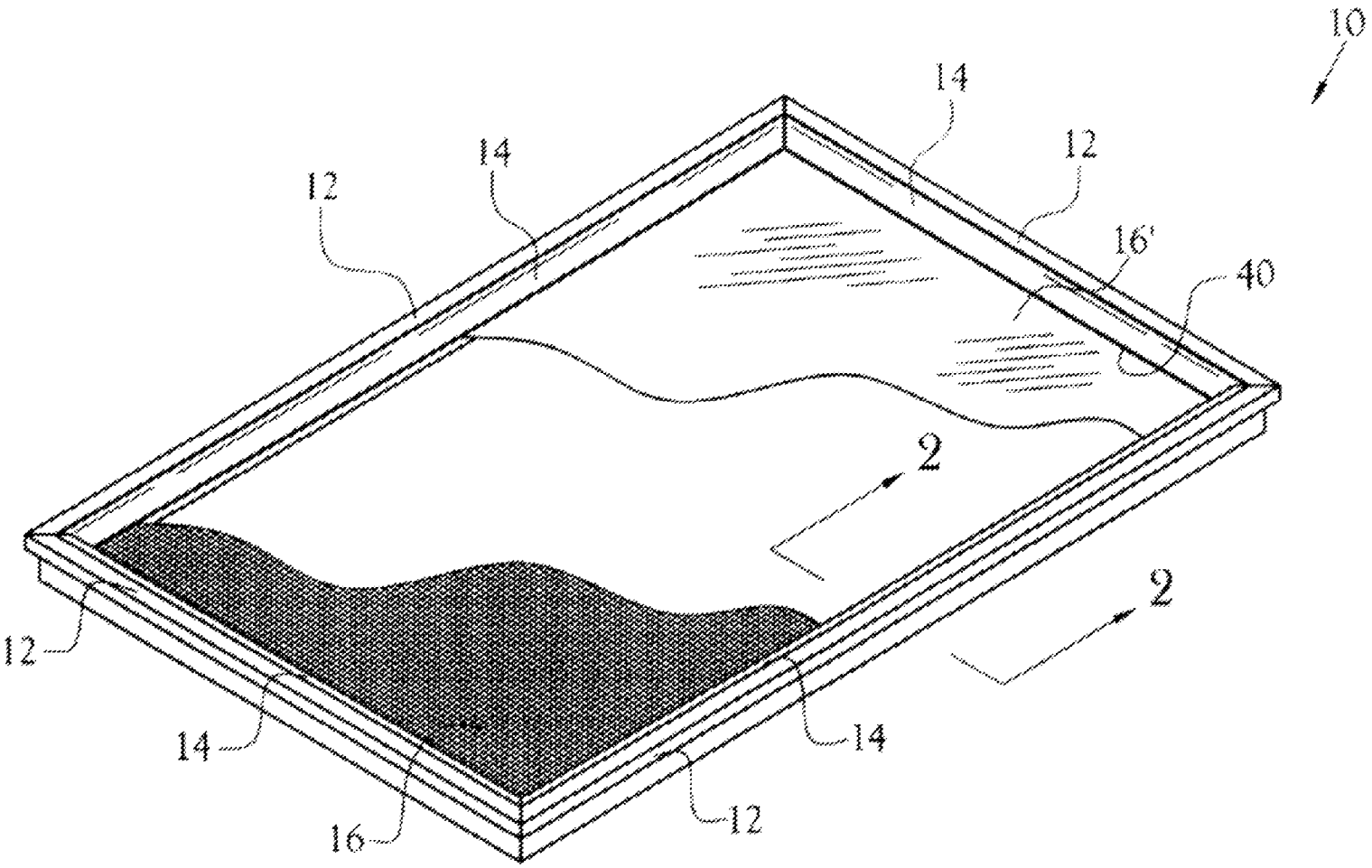
FIG. 1 is a perspective view of the window screen installation system.

For the purposes of promoting an understanding of the principles of the invention, reference will now be made to the embodiments illustrated in the drawings and specific language will be used to describe the same. It will nevertheless be understood that no limitation of the scope of the invention is thereby intended, any alterations and further modifications in the illustrated embodiments, and any further applications of the principles of the invention as illustrated therein as would normally occur to one skilled in the art to which the invention relates are contemplated herein.

A window screen installation system incorporating various features of the present invention is illustrated generally at 10 in the figures. The window screen installation system 10, which primarily includes a screen frame 12 and trim mold 14, is designed for releasably mounting a screen fabric 16 or other pliable sheet material in such a manner as to self-tighten the fabric or material during installation. While a hammer may be used to secure the trim mold 14 to the screen frame 12, tightening of the screen or fabric 16 is accomplished without the use of any tools. Moreover, the screen frame 12 and trim mold 14 are designed to allow for the mounting of the screen or fabric 16 without damaging the same such that it may be removed and reused as required.

A screen fabric 16 may be installed for use in such applications as a storm door or a window screen, or for larger applications such as screened-in porches. However, in colder seasons, it may be preferable to replace the screen fabric 16 with a transparent sheet material 16' such as vinyl. Accordingly, the present invention is designed to allow for the replacement of the screen fabric 16 with the sheet material 16', and vise versa. For ease of description, use of the term "screen 16" is intended to include a conventional screen fabric 16, a conventional transparent sheet material 16', or any other pliable sheet that may be used as a membrane in the screen frame 12.

Illustrated in FIG. 1 is a perspective view of a screen frame 12 of the present invention. In order to illustrate the various uses of the screen frame 12, a portion of a screen fabric 16 is shown in the lower portion of the frame 12, while a portion of a transparent sheet material 16' is shown in the upper portion of the screen frame 12. Thus it is clearly seen that the screen frame 12 and trim mold 14 are designed for use in various environments and applications.

Figure 2:
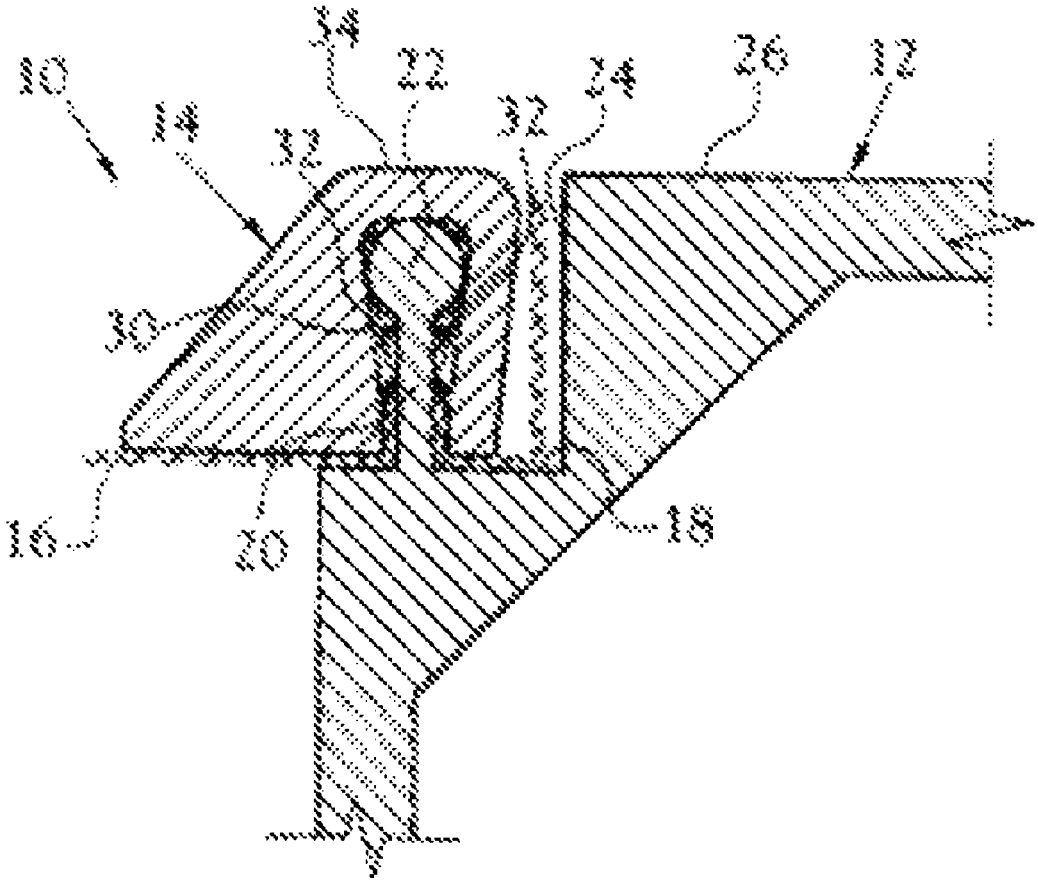
FIG. 2 is an elevation view, in section, of the window screen installation system taken at 2-2 in FIG. 1.

As more clearly illustrated in FIG. 2, the screen 16 is disposed and held securely in place between the screen frame 12 and the trim mold 14. To accomplish the disposition and retention of the screen 16, the screen frame 12 and trim mold 14 are each extruded members. The screen frame extrusion 12 defines a mounting surface 18 preferably disposed below and parallel to an exterior face 26. A vertical surface 24 extends between and perpendicular to the exterior face 26 and the mounting surface 18. A mounting rib 20 extends along the mounting surface 18 and parallel to the vertical surface 24. The mounting rib 20 terminates below the exterior face 26. A bead 22 is defined at the terminal edge of the mounting rib 20 to serve as a locking mechanism.

The trim mold 14 is configured to closely receive the mounting rib 20 of the screen frame extrusion 12. To this extent, the trim mold 14 defines a channel opening 30 on the bottom surface thereof and extending into the trim mold 14 a depth substantially equal to the height of the mounting rib 20. A plurality of retention barbs 32 disposed at an upward angle with respect to the mounting rib 20 are formed in the channel 30 to engage the mounting rib bead 22 in order to prevent inadvertent removal of the trim mold 14 from the mounting rib 20.

Further, the trim mold 14 is configured to be received within a volume defined generally by the vertical surface 24 and the mounting surface 18 of the screen frame extrusion 12. In one form, the trim mold 14 defines an exterior face 34 which is disposed substantially co-planar with the screen frame extrusion 12 when installed. Such disposition is accomplished by equating the thickness of the trim mold 14 from the extent of the channel 30 to the trim mold exterior face 34 with the difference in the height of the screen frame extrusion vertical surface 24 less the height of the mounting rib 20 and bead 22. In one form, as described, the height of the mounting rib 20 and bead 22 and the depth of the channel 30 are substantially equal. Accordingly, in order to accomplish the co-planar relationship of the screen frame extrusion exterior face 26 and the trim mold exterior face 34, the overall height of the trim mold 14 is substantially equal to the height of the screen frame extrusion vertical surface 24. However, it will be understood by one skilled in the art that other configurations may be as suitable in particular applications.

In order to install a screen 16 in the screen frame 12 of the present invention, the screen 16 is laid over the screen frame extrusion 12 at approximately the point to be attached. The trim mold 14 is then placed over the mounting rib 20 and pressed toward the screen frame extrusion 12 such that the screen 16 is deformed over the mounting rib 20 and the mounting rib 20 and screen 16 are both received within the trim mold channel 30. The screen 16 is thus tightly received between the mounting rib 20 and the channel 30, with the retention barbs 32 assisting in the retention thereof. In order to remove the screen 16, the trim mold 14 is simply pried away from the screen frame extrusion 12 with, for example, a flat head screwdriver. Thus, mounting and removal of the screen 16 typically do not damage the screen 16 as a result of not requiring the use of conventional fasteners such as screws.

Figures 3, 4, 5, 6:
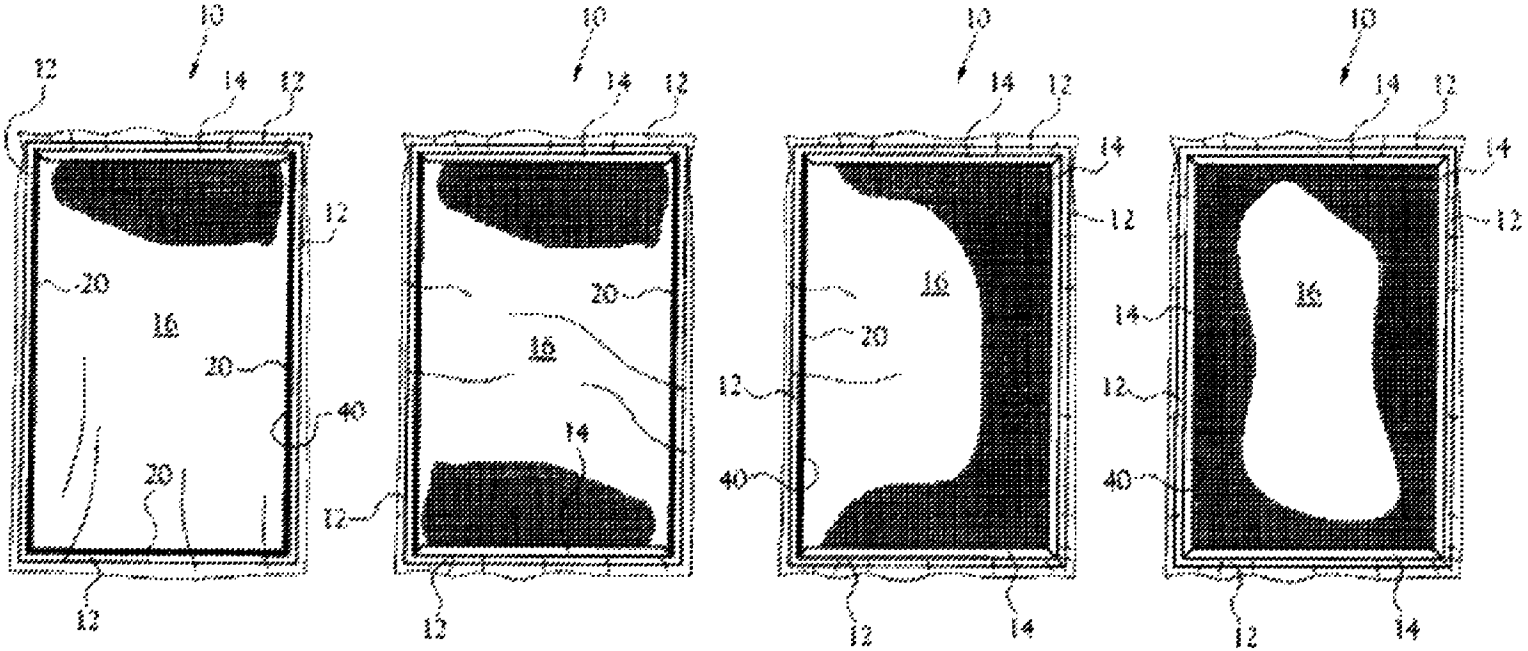
FIG. 3 is a top view plan view of the window screen installation system showing a first trim mold mounted thereon.
FIG. 4 is a top view plan view of the window screen installation system showing a second trim mold mounted thereon.
FIG. 5 is a top view plan view of the window screen installation system showing a third trim mold mounted thereon.
FIG. 6 is a top view plan view of the window screen installation system showing a fourth trim mold mounted thereon.

FIGS. 3-6 illustrate in a step-by-step fashion the installation of a screen 16 on a screen frame 12. As illustrated in FIG. 3, a screen 16 dimensioned at least slightly larger than the opening 40 defined by the screen frame 12 is positioned on top of the screen frame 12 and the trim mold 14 corresponding to a first screen frame extrusion 12 is snapped into place. Then as illustrated in FIG. 4, the opposing trim mold 14 is snapped into place. Prior to snapping the trim mold 14 into place, the screen 16 is gently pulled to remove excess slack. However, slack approximately equal to the height of the mounting rib 20 is automatically removed from the screen 16 when the second trim mold 14 is placed. By placing opposing trim molds 14 in this manner, slack is removed from the screen 16 in an end-to-end fashion, with some slack remaining side-to-side. FIGS. 5 and 6 illustrate a similar procedure from side to side to remove the remaining slack and to complete the screen mounting process. With the placement of each of the third and fourth trim molds 14, slack approximately equal to the height of the mounting rib 20 is taken from each side of the screen 16, leaving a tightened screen mounted on the screen frame 12.

Figure 7:
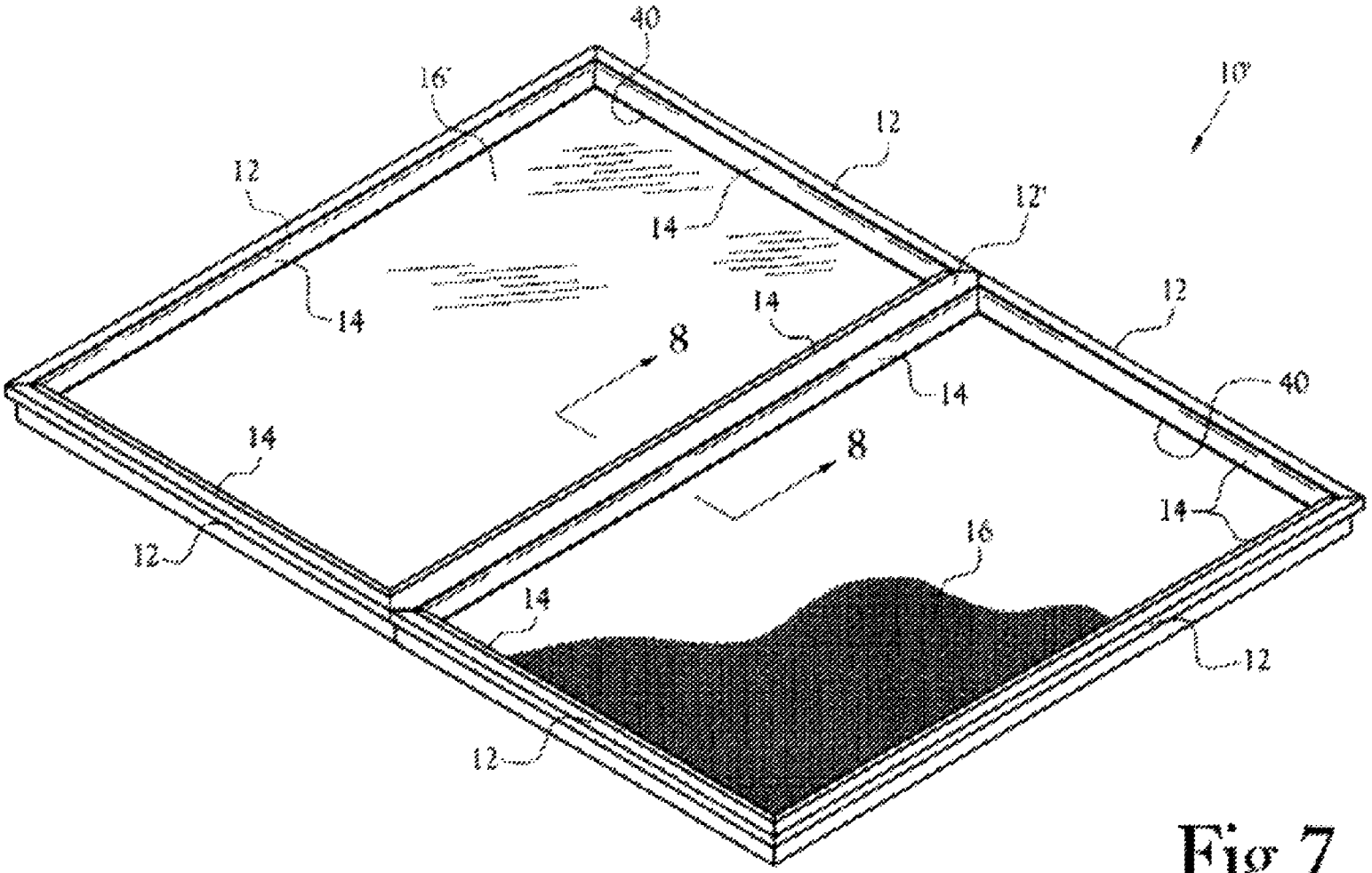
FIG. 7 is a perspective view of an alternative window screen installation system.
Figure 8:
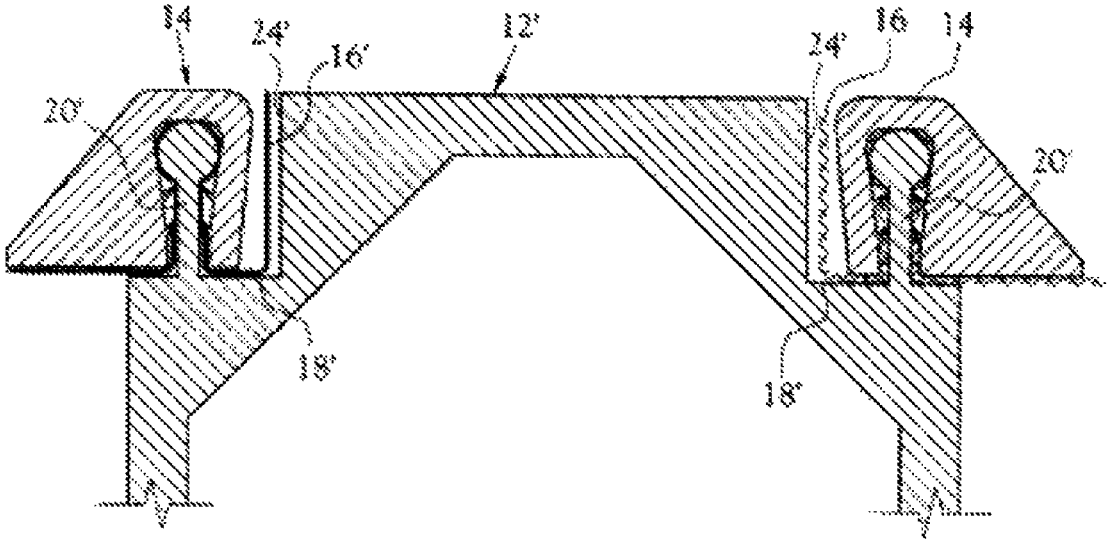
FIG. 8 is an elevation view, in section, of the window screen installation system taken at 8-8 in FIG. 7.

FIGS. 7 and 8 illustrate generally a further embodiment of the screen frame 10' of the present invention wherein the screen frame extrusion 12' defines a symmetrical configuration such as to include opposing mounting ribs 20'. In this embodiment, as illustrated in FIG. 7, successive screen panels 16 are installed for uses such as side-by-side windows, screened-in patios, or the like. Illustrated for purposes of clarifying a variety of uses of the screen frame 10' of the present invention, one panel is shown to be a screen fabric 16, while the other panel is shown to be a transparent material 16' such as vinyl. As best illustrated in FIG. 8, the screen frame extrusion 12' defines opposing vertical surfaces 24', mounting surfaces 18' and mounting ribs 20'. Each, however, functions in similar fashion to that of the previously described embodiment.

Figure 9:
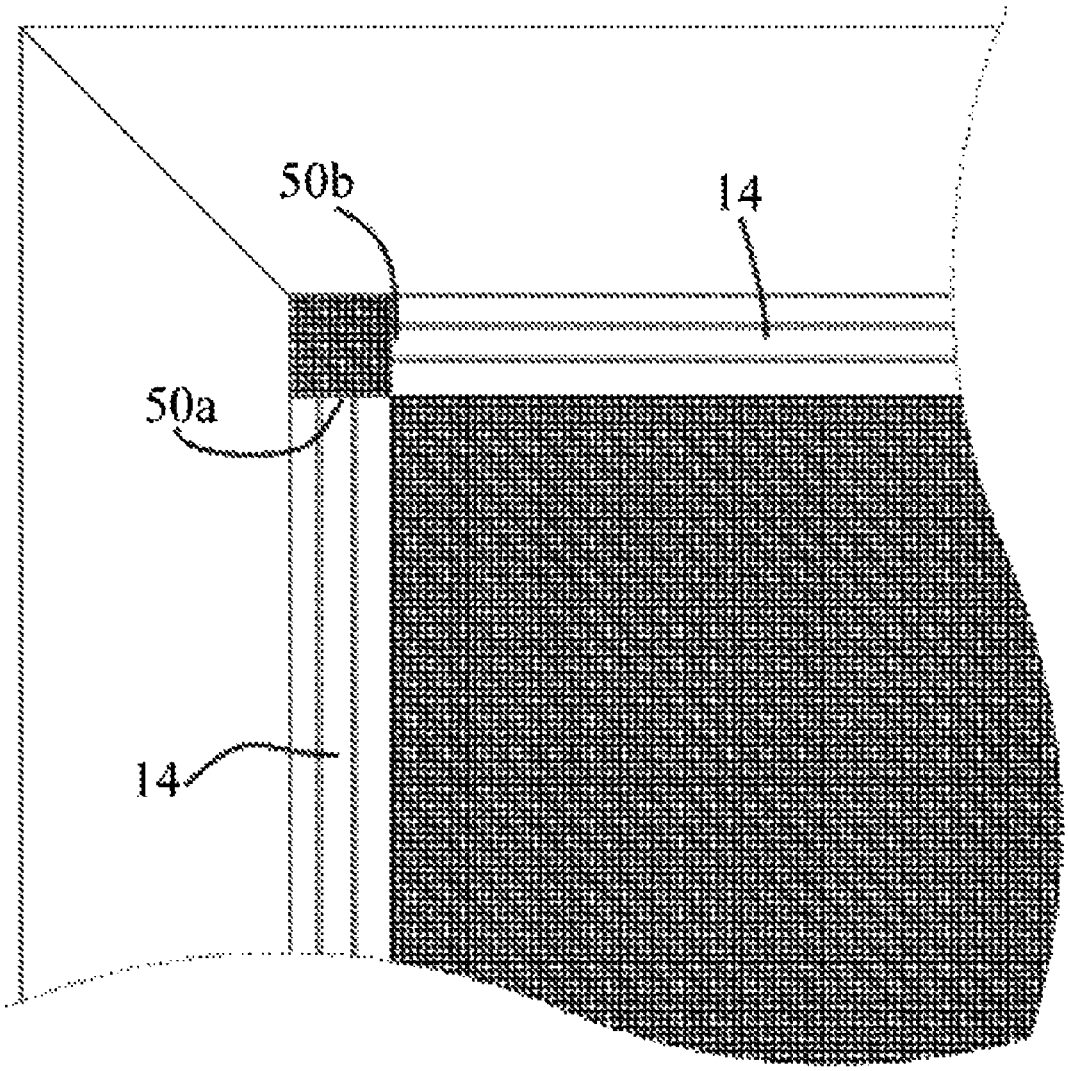
FIG. 9 illustrates a corner portion of a window screen installation system showing to trim molds adjacent to one another defining a generally rectangular shaped opening.

Referring to FIG. 9, a pair of trim molds 14 are illustrated connected with a pair of screen frames 12 (not illustrated, see e.g. FIG. 2) that are mounted on a mounting surface. As illustrated, the trim molds 14 are snapped onto the screen frames 12 thereby securing the screen panel 16 to the screen frames 12. In this form, respective ends 50*a*, 50*b* of the trim molds 14 are positioned adjacent one another thereby leaving a generally square shaped gap or opening between the ends 50*a*, 50*b* of the trim molds 14.

Figure 10:
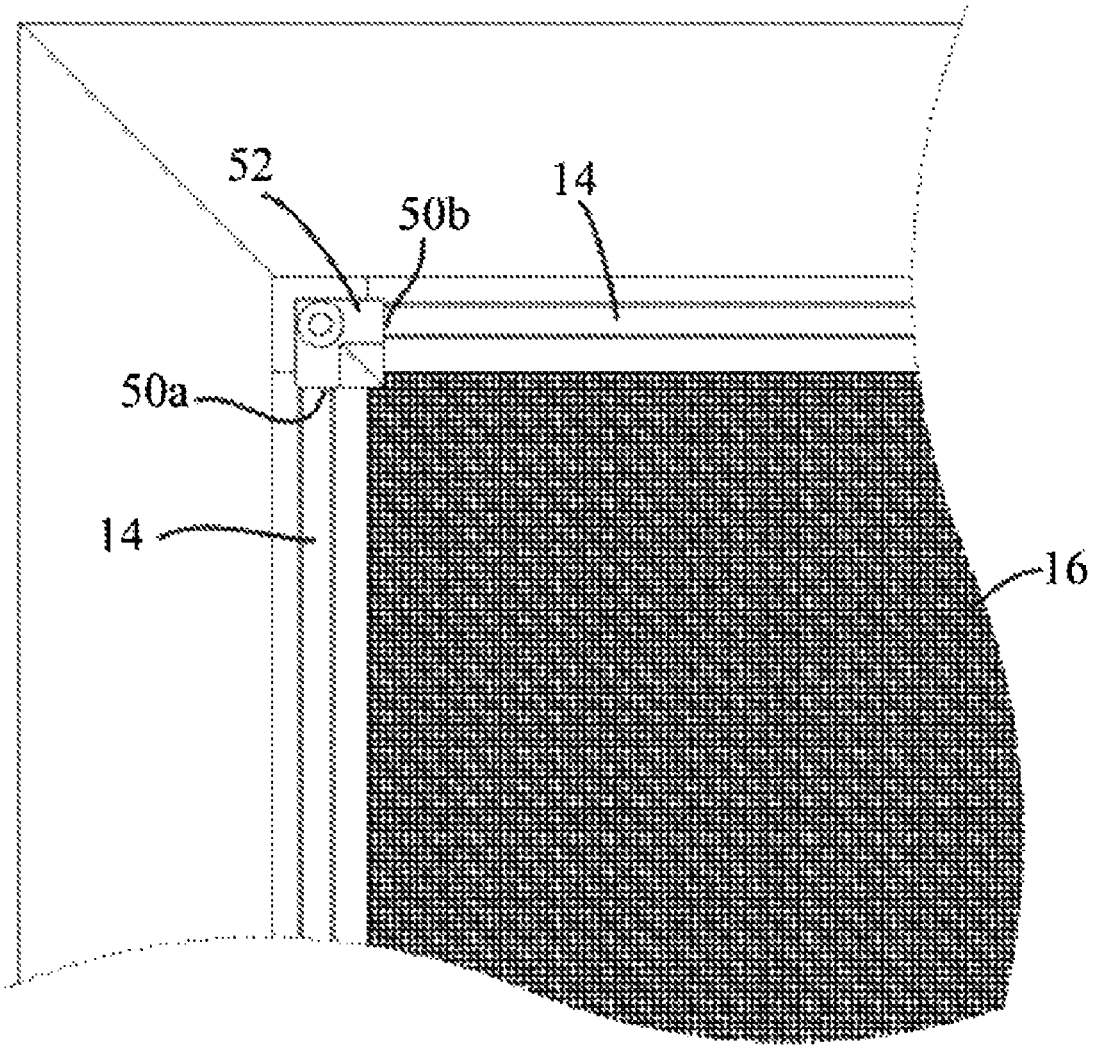
FIG. 10 illustrates a corner portion of a window screen installation system showing to trim molds adjacent to one another showing a plinth installed over the respective ends of the adjacent trim molds.
Figure 11:
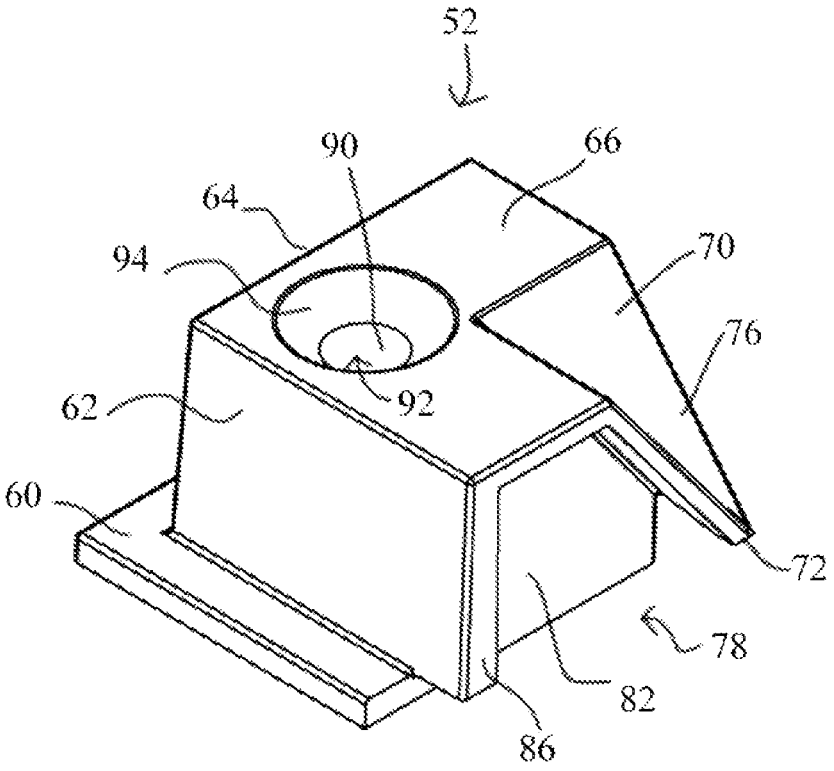
FIG. 11 is a perspective view of a plinth used in the window screen installation system.

Referring to FIG. 10, a plinth 52 is positioned over a portion of the ends 50*a*, 50*b* of the trim molds 14. The plinth 52 is used to help further secure the trim molds 14 to the screen frames 12. In one form, the plinth 52 is secured to the ends 50*a*, 50*b* of the trim molds 14 by a securing mechanism 54, such as a screw in one form. The securing mechanism 54 is screwed into the mounting surface. It should be appreciated that in other forms the plinth 52 could be secured to the trim molds 14 using other securing mechanisms, such as glue or an epoxy. The plinth 52 completes the corner between the two respective trim molds 14.

Referring collectively to FIGS. 11-14, more detailed views of the plinth 52 is illustrated. The plinth 52 includes a base portion 60 that runs horizontally in relation to first and second vertical outer wall 62, 64 that extend upwardly or vertically from the base portion 60. The first and second vertical outer walls 62, 64 extend upwardly toward and are connected with an upper portion or surface 66 that runs perpendicular with the base portion 60. In one form, the upper portion 66 has a generally L-shaped configuration.

Figure 12:
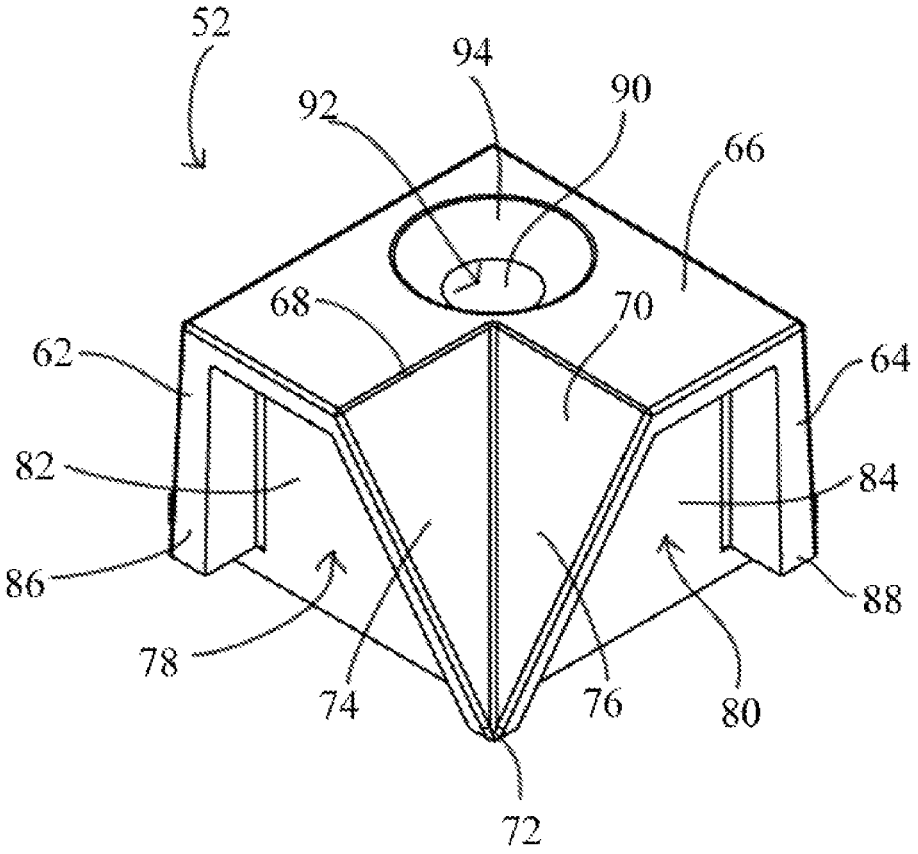
FIG. 12 is another perspective view of the plinth used in the window screen installation system.
Figure 13:
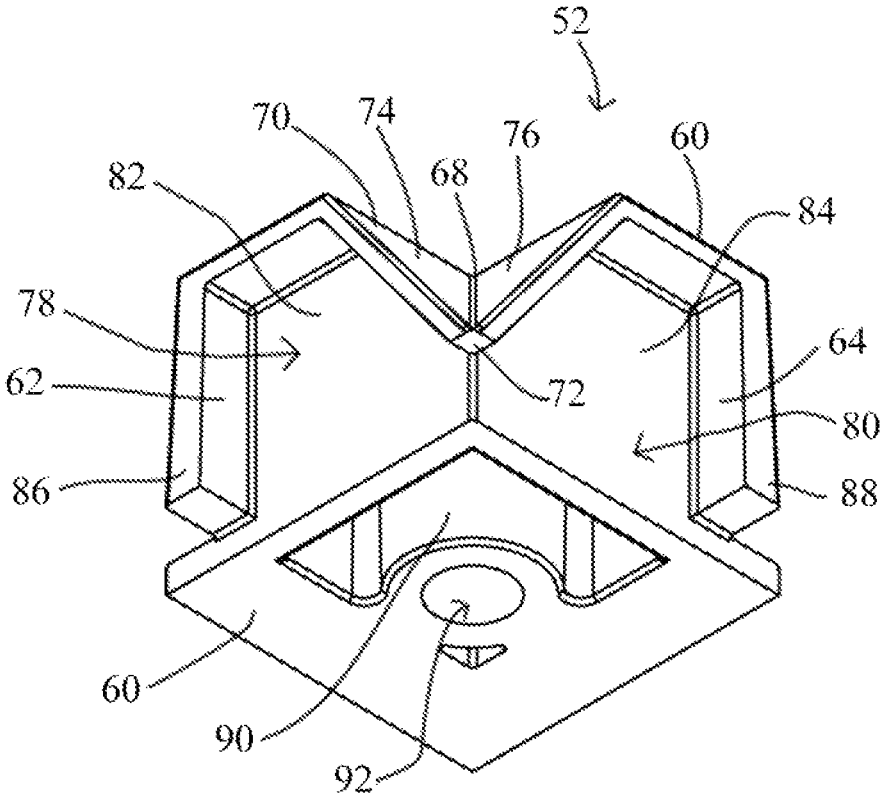
FIG. 13 is another perspective view of the plinth used in the window screen installation system.
Figure 14:
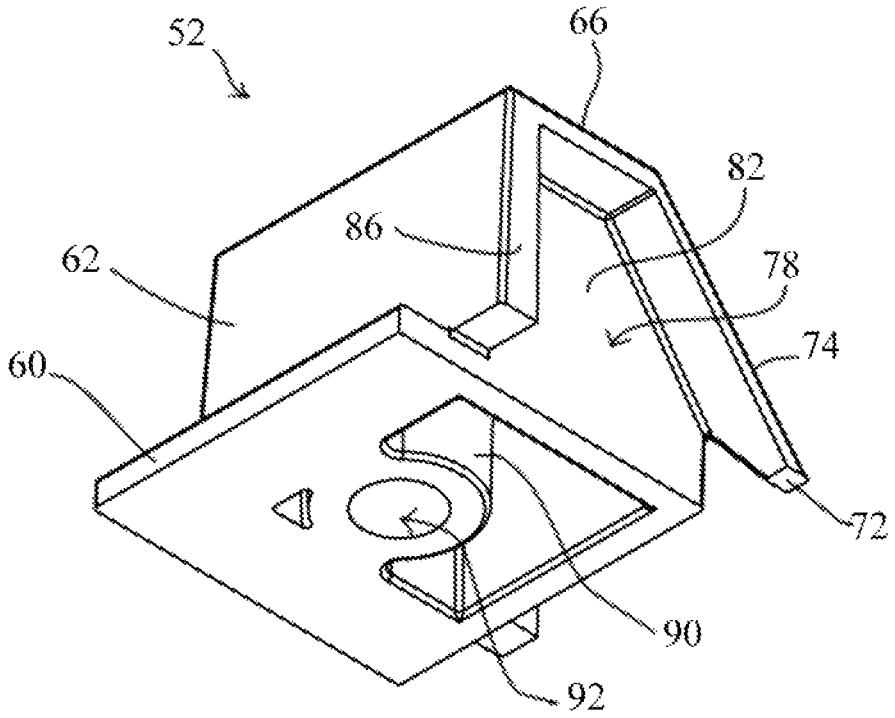
FIG. 14 is yet another perspective view of the plinth used in the window screen installation system.

As illustrated best in FIG. 12, an inside portion 68 of the upper portion 66 includes a tapered portion 70 that extends downwardly and outwardly toward a tapered end 72. The inside portion 68 begins at about the center of the upper portion 66 and extends outwardly in two directions toward outside edges of the upper portion 66. In one form, the tapered portion 70 comprises a first tapered portion 74 and a second tapered portion 76. As illustrated, the first and second tapered portions 74, 76 have a generally triangular shape. In one form, the first and second tapered portions 74, 76 taper outwardly from the upper portion 66 at an angle of approximately 127°. As illustrated, the first and second tapered portions 74, 76 taper downwardly and converge at the tapered end 72.

The first tapered portion 74, a portion of the upper surface 66, and a portion of the first vertical outer wall portion 62 define a first trim mold receiving cavity 78. The second tapered portion 76, a portion of the upper surface 66, and a portion of the second vertical outer wall portion 64 define a second trim mold receiving cavity 80. The first and second trim mold receiving cavities 78, 80 are configured to be shaped like the upper surface of the trim mold 14. A first recessed vertical wall portion 82 is included within the first trim mold receiving cavity 78. A second recessed vertical wall portion 84 is included within the second trim mold receiving cavity 80. In one form, the first and second recessed vertical wall portions 82, 84 are recessed from outer edges 86, 88 of the first and second vertical outer wall portions 62, 64 by approximately ⅛ of an inch. As such, the first and second vertical outer walls 62, 64 extend away from the base portion 60 approximately ⅛ of an inch. As illustrated in FIG. 10, the ends 50*a*, 50*b* of the trim molds 14 are configured to be received in the first and second trim mold receiving cavities 78, 80.

As illustrated in FIGS. 11-14, the plinth 52 includes a securing member housing 90 that includes an aperture 92 running through the securing member housing 90. The securing member housing 90 extends from a lower surface of the upper surface 66 to a lower surface of the base 60. In one form, the aperture 92 is sized and configured to receive a #8 flat head screw. In addition, the upper surface 66 of the plinth 52 includes a countersink 94. In one form, the countersink 94 is sized and configured to receive the head of a #8 flat head screw. Those skilled in the art would recognize that other sizes could be used in other forms of the invention.

Figure 15:
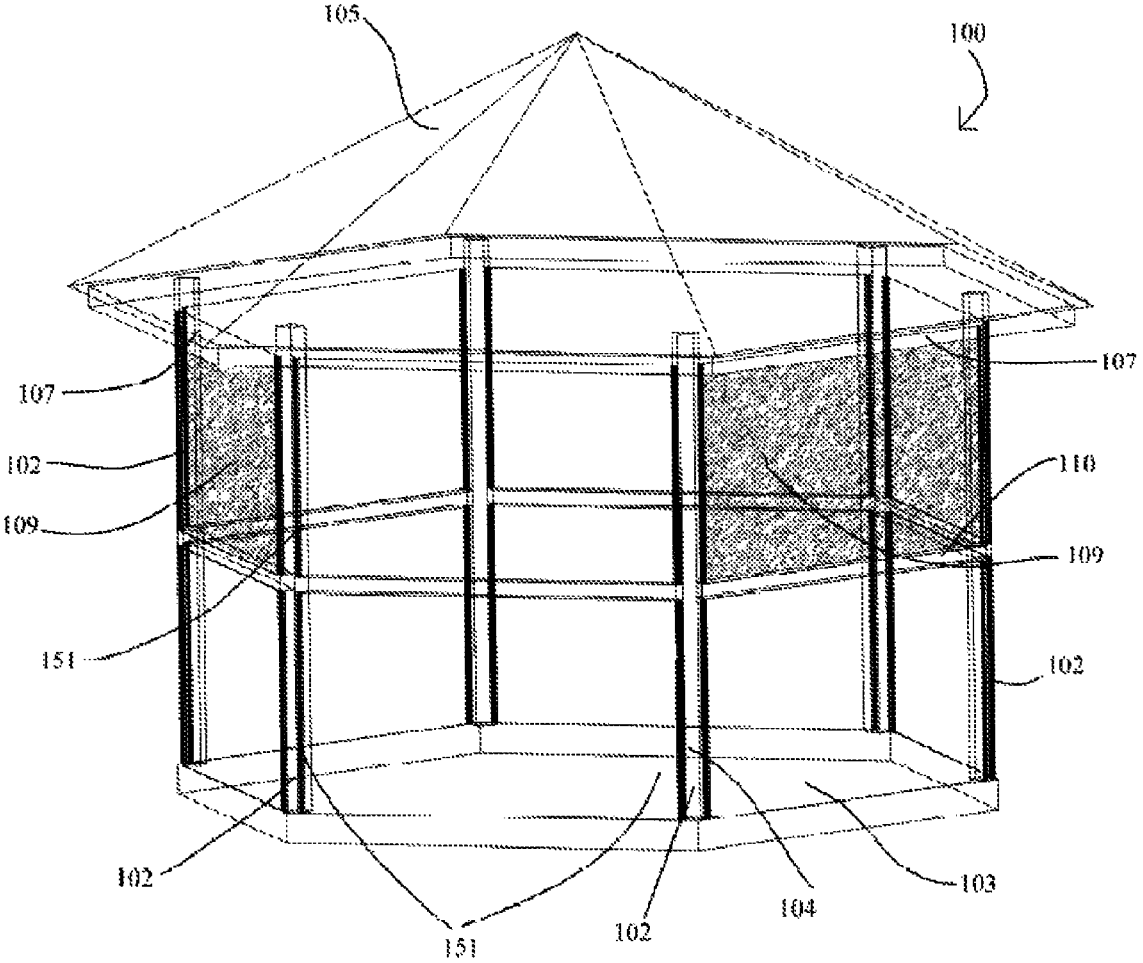
FIG. 15 is a representative hexagonal gazebo.

Referring to FIG. 15, a hexagonal gazebo 100 is illustrated that includes a plurality of vertical posts or support members 102 arranged in a hexagonal configuration. Although a hexagonal gazebo 100 is illustrated in this form, it should be appreciated that other gazebo configurations such as, for example, octagonal could be applicable to the present invention. The gazebo 100 illustrated should be viewed broadly as an illustrative example of a gazebo in which the present invention may be utilized and not as a limitation of the present invention. The gazebo 100 includes a base or floor 103 and a roof 105. A lower end of the vertical support members 102 is connected with the floor 103. An upper end of the vertical support members 102 is connected with one or more horizontal support members 107. In one form, the roof 105 is connected with the vertical and horizontal support members 102, 107.

Figure 16:
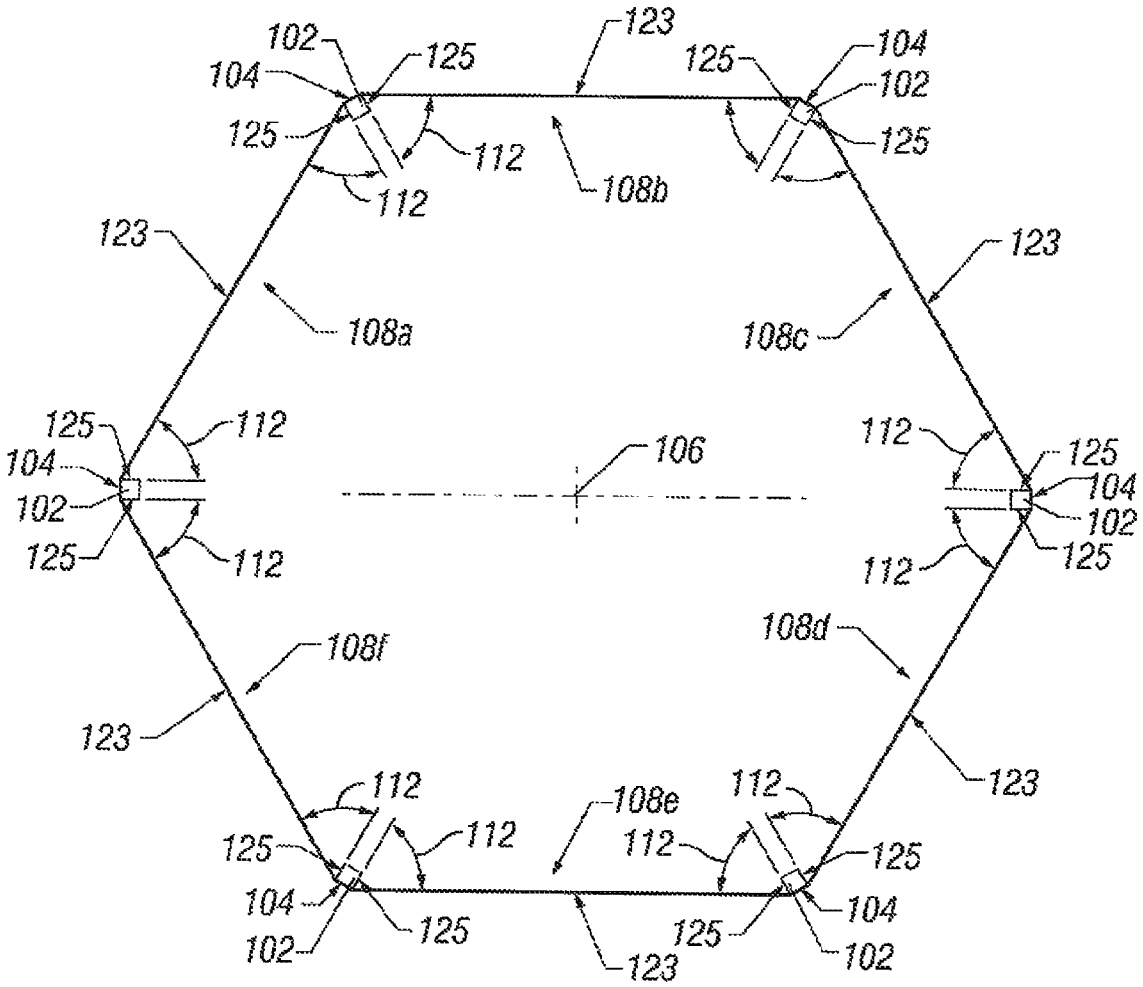
FIG. 16 illustrates a cross-sectional view of a portion of the gazebo illustrated in FIG. 15 showing vertical support members and a screen material spanning between vertical support members.

Referring to FIG. 16, a top view of a portion of the hexagonal gazebo 100 is illustrated. As previously set forth, the gazebo 100 includes a plurality of vertical posts or support members 102 arranged in a hexagonal configuration in this representative form.

In one form, the support structures 102 may comprise severe weather pressure treated 6"×6" posts, although other size posts and posts made from other materials (e.g. —composites) may be used in other forms. The support members 102 of the gazebo 100 are arranged such that a flat outer surface 104 of the support members 102 face outwardly from a central point or location 106 of the gazebo 100. As such, each respective post 102 is set at a different angle relative to adjacent posts 102 (e.g. 60 degrees, 45 degrees, and so forth).

As illustrated in FIG. 16, a plurality of openings 108*a-f* are defined between respective vertical support members 102. Referring back to FIG. 15, positioned between each opening 108*a-f* is one or more screen assemblies 151 that include a screen material 109. Two respective screen assemblies 151 are positioned between each respective opening 108*a-f* in this illustrative gazebo 100. A central horizontal support member 110 is positioned between upper and lower screen assemblies 151. The upper screen assembly 151 is connected with the upper horizontal support member 107, a portion of a first vertical support member 102, the central horizontal support member 110, and a portion of a second vertical support member 102. The lower screen assembly 151 is connected with the base or floor 103, a portion of the first vertical support member 102, the central horizontal support member 110, and a portion of the second vertical support member 102. This may repeat for each opening 108*a-f* around the gazebo 100. It should be appreciated that any number of screen assemblies 151 may be positioned between the openings 108*a-f* defined by the vertical support members 102.

Referring to FIG. 16, a general discussion of an illustrative prior method of installing screens systems in gazebos is set forth below. In this illustrative prior method, screen material 123 is stretched across the openings 108*a-f* and secured to the vertical support members 102 by a strip of trim material that is secured to the flat outer surface 104 of the vertical support members 102. This method is impractical and results in gazebo screens that are weak, cheap looking in appearance, and difficult to install and replace.

As illustrated, because of the positioning of the vertical support members 102 relative to the central point 106 of the gazebo 100, a screen post angle 112 is defined between an interior side 125 of the vertical support members 102 and the screen material 123. In a hexagonal gazebo configuration, the screen post angle 112 is approximately 60 degrees. In an octagonal gazebo configuration, the screen post angle 112 is approximately 45 degrees. As such, the size of the screen angle 112 decreases as more sides are added to the gazebo design. The screen angle 112 may be calculated as follows: (360 degrees/number of gazebo sides). As set forth in greater detail below, a backing wedge strip 152 is utilized to correct the angular relationship of the vertical support members 102 to align screen frames 154 at a 90 degree angle relative to the screen material 109.

As illustrated in FIG. 16, the outward facing arrangement of the vertical support members 102 in relation to the central point 106 prohibits a traditional square or rectangular shaped screen frame, or window frame for that matter, from fitting within the openings 108*a-f* defined by the vertical support members 102. As a result, a need exists for a manner in which to easily install screening systems in various different type of gazebo designs.

Figure 17:
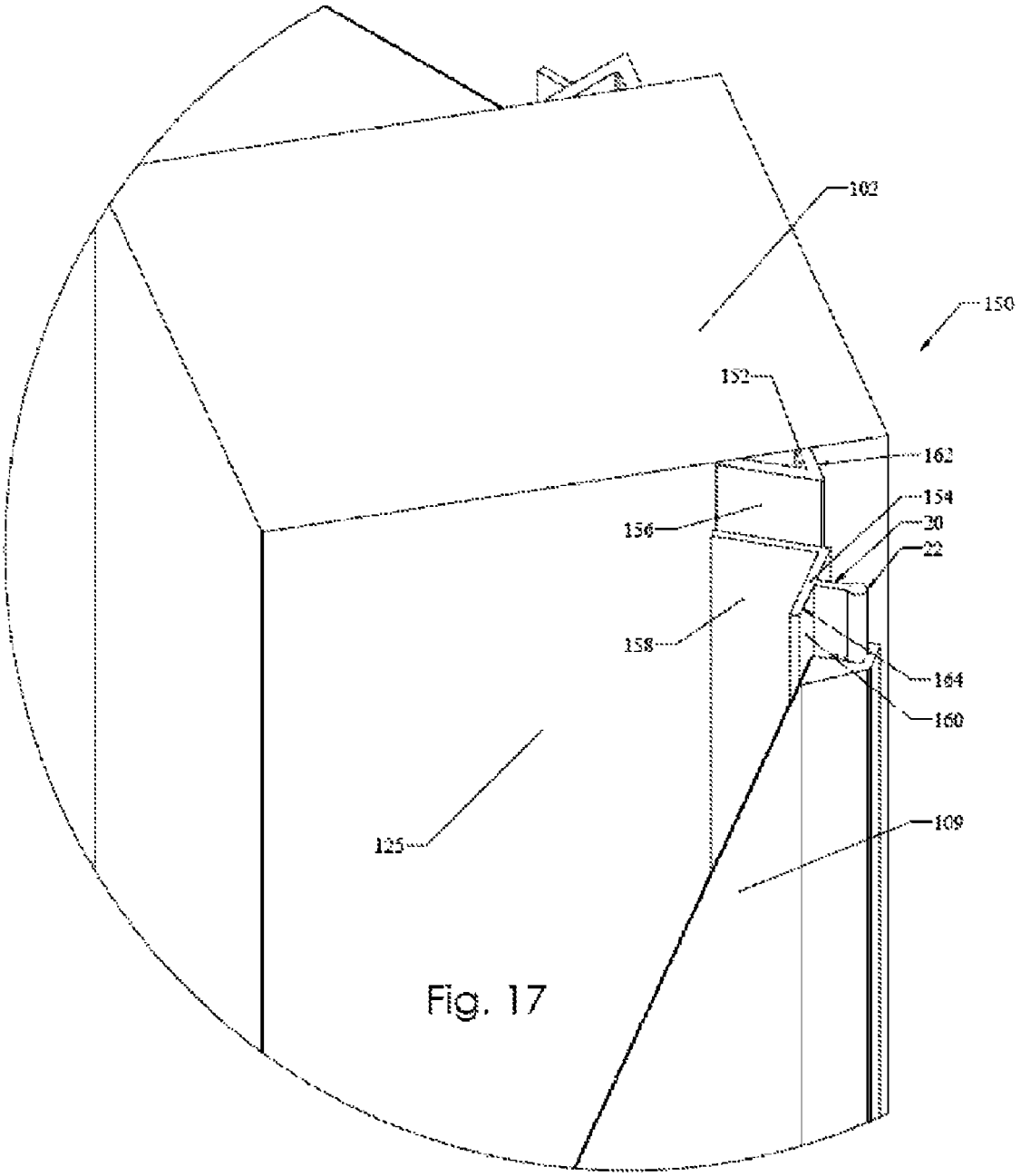
FIG. 17 illustrates certain components of a gazebo screen installation system.

Referring to FIG. 17, a gazebo screen installation system 150 is disclosed that includes some of the same and additional features previously described in connection with other forms of the present invention, which are incorporated herein by reference. As illustrated, the gazebo screen installation system 150 includes a wedge strip 152 that is connected with the interior side 125 of the vertical support member or post 102. The wedge strip 152 may be connected with the support member 102 by an adhesive, screw, or any other similar securing mechanism. A gazebo screen frame 154 is connected with an outside angled surface 156 of the backing wedge strip 152. In one form, the wedge strip 152 and screen frame 154 have a length equal to approximately the length of each respective screen assembly 151 needed to cover the vertical portion of the openings 108*a-f* in which it is positioned.

The gazebo screen frame 154 has a generally L-shaped configuration with a wedge portion 158 and a trim portion 160. As illustrated, in this form the wedge portion 158 is positioned at a 90 degree angle relative to the trim portion 160. The trim portion 160 extends outwardly and away from the outside angled surface 156 of the wedge strip 152. In this form, an outside surface 162 of the wedge strip 152 is aligned flush with an outside surface 164 of the gazebo screen frame 154 and also the outer surface 104 of the vertical support members 102. A mounting rib 20 extends upwardly from and perpendicular to the outside surface 162. A bead 22 is defined at the terminal edge of the mounting rib 20 to serve as a locking mechanism as previously set forth.

Figure 18:
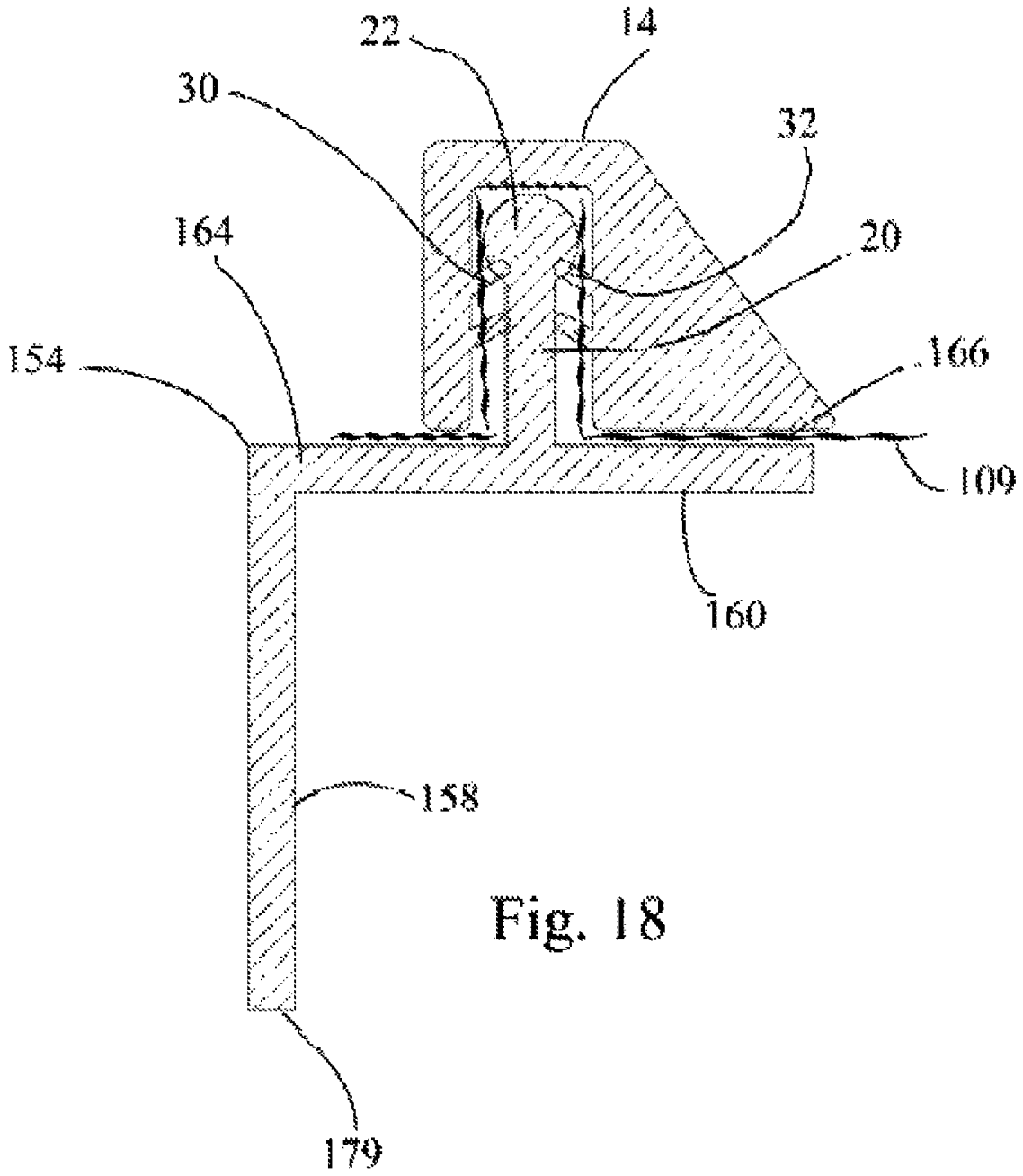
FIG. 18 is a cross-sectional view of another portion of the gazebo screen installation system.

Referring to FIG. 18, a cutaway side view of a respective gazebo screen frame 154 having a trim mold 14 connected with the gazebo screen frame 154 is depicted. The trim mold 14 is configured to closely receive the mounting rib 20 of the gazebo screen frame 154. The trim mold 14 defines a channel opening 30 on the bottom surface thereof and extending into the trim mold 14 a depth substantially equal to the height of the mounting rib 20. A plurality of retention barbs 32 extend at a downward angle from the mounting rib 20 to prevent inadvertent removal of the trim mold 14 from the mounting rib 20 and to further secure the screen material 109 within the trim mold 14.

As further illustrated, a sheet of screen material 109 is positioned between the outside surface 164 of the gazebo screen fame 154 and a lower surface 166 of the trim mold 14. In addition, the screen material 109 is positioned in the channel opening 30 such that the screen material 109 is secured around the mounting rib 20 by the trim mold 14. As with the previous forms, the trim mold 14 snaps on and off of the mounting rib 20 thereby allowing the screen material 109 to readily be installed, adjusted, and replaced if damaged.

Figure 19:
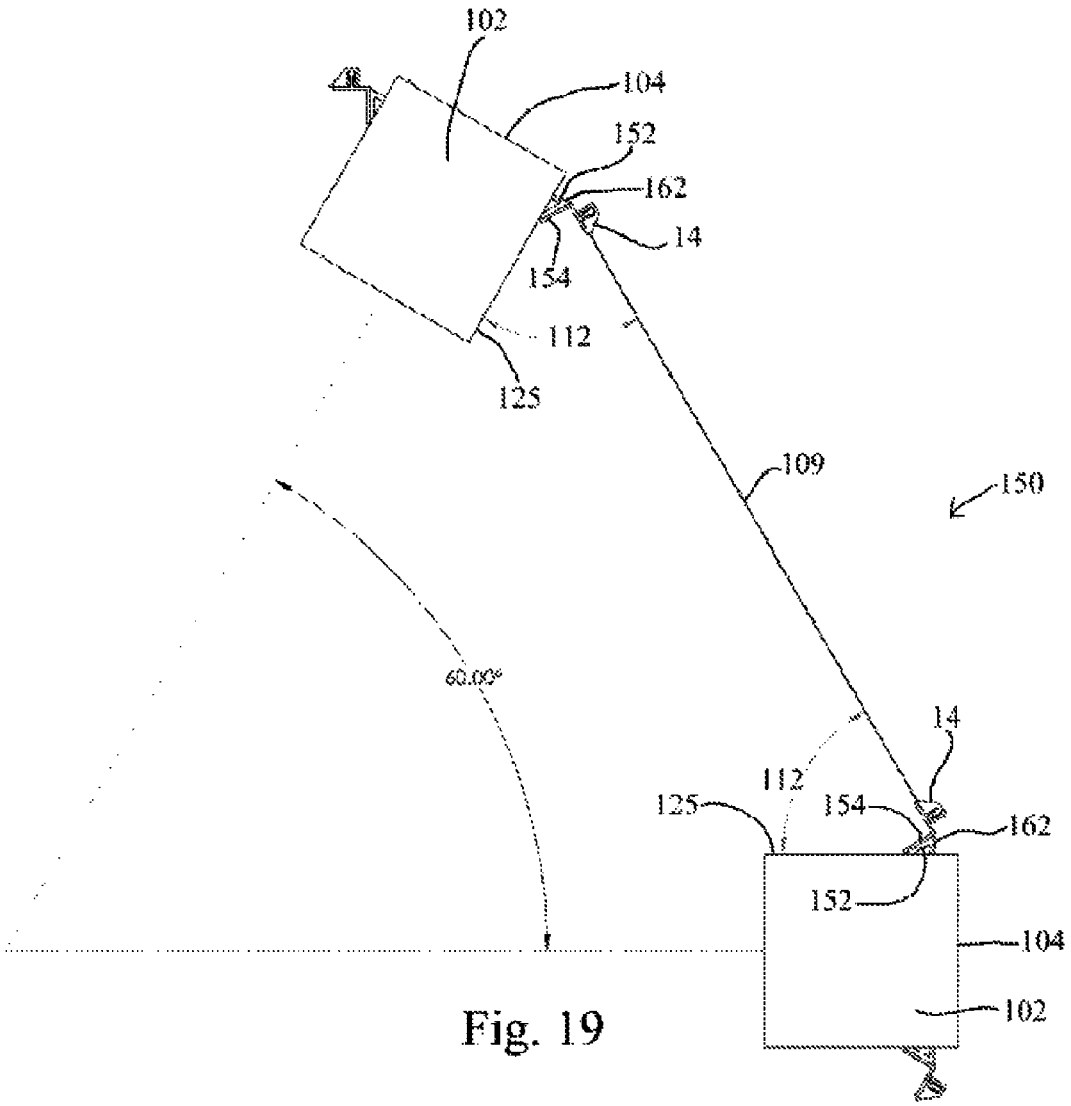
FIG. 19 illustrates another cross-sectional view of a portion of the gazebo screen installation system.

Referring to FIG. 19, a cut-away top view of a portion of the gazebo 100 is illustrated in which the vertical support members 102 are oriented in a 60 degree orientation to one another. As previously set forth, in a hexagonal gazebo the vertical support members 102 are angled 60 degrees in relation to one another from the central point 106 of the gazebo 100. In an octagonal gazebo, the vertical support members 102 are oriented in relation to one another at 45 degrees and so on. As such, the more sides that are added to the gazebo, the smaller the vertical support member angles become in relation to one another.

In order to orient the gazebo screen frames 154 parallel with one another, a backing wedge strip 152 is positioned between each respective interior side 125 of the vertical support members 102 and the gazebo screen frame 154. The backing wedge strip 152 is configured such that the angled surface 156 forms a right angle in relation to the position of the screen material 109 spanning in the opening between the two respective vertical support members 102. In this form, the angled surface 156 has a 60 degree angle in relation to the outside surface 162 of the wedge strip 152 thereby forming a right angle with the screen material 109 when mounted on the interior side 125 of the vertical support member 102. As such, the angled surface 156 of the backing wedge strip 152 has a right angle forming angle 168 (See FIG. 20) in relation to the screen frame 109. In a hexagonal gazebo, the right angle forming angle 168 is 30 degrees and in an octagonal gazebo the right angle forming angle 168 is 22.5 degrees.

Figure 20:
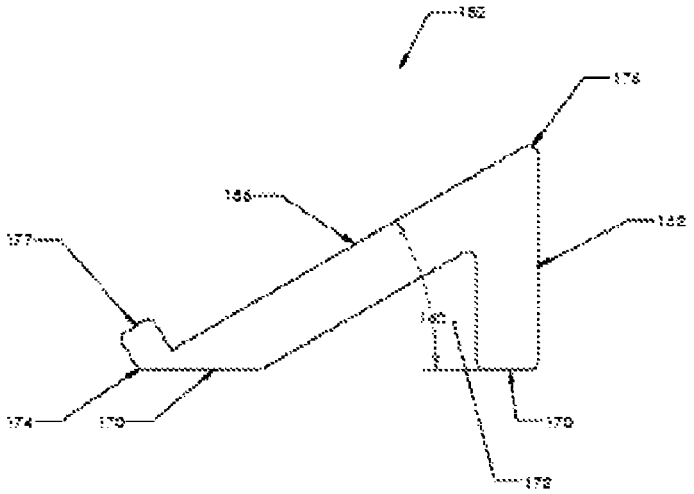
FIG. 20 illustrates a representative backing wedge strip of the gazebo screen installation system.

Referring to FIG. 20, a representative gazebo wedge strip 152 is illustrated that includes angled surface 156 and outside surface 162. As previously set forth, in the hexagonal gazebo 100 implementation, the gazebo wedge strip 152 has a right angle forming angle 168 of 30 degrees. The right angle forming angle 168 is formed between a flat wedge strip mounting surface 170 of the gazebo wedge strip 152 and the angled surface 156. In this form, the outside surface 162 has a 90 degree angle in relation to the mounting surface, but other angles may be used in other forms. Although a recess 172 is illustrated in the gazebo wedge strip 152 shown, in other forms the gazebo wedge strip 152 may not include the recess 172 thereby forming a continuous mounting surface 170.

As further illustrated, the angled surface 156 of the gazebo wedge strip 152 includes a proximal end 174 and a distal end 176. The proximal end 174 of the angled surface 156 includes a rib 177 extending away from the angled surface 156. In one form, an end 179 of the wedge portion 158 of the gazebo screen frame 154 is positioned against the rib 177 when the backing wedge strip 152 is connected with the gazebo screen frame 154.

Figure 21:
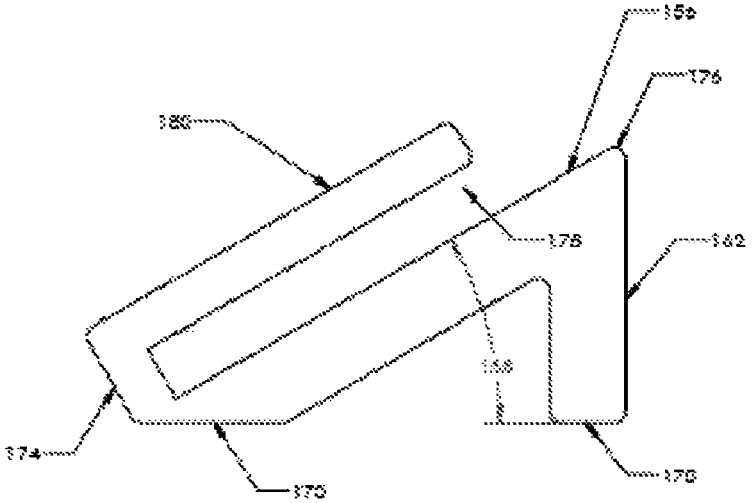
FIG. 21 illustrates another representative backing wedge strip of the gazebo screen installation system.

As illustrated in FIG. 21, in yet another form the proximal end 174 of the wedge strip 152 includes a wedge receiving slot 178. The wedge receiving slot 178 is defined by an L-shaped member 180 connected with the proximal end 174 of the angled surface 156 of the wedge strip 152 and travels a predetermined distance toward the distal end 176. In this form, the wedge portion 158 of the gazebo screen frame 154 is configured to be received within the wedge receiving slot 178. In one form, the gazebo wedge strip 152 is approximately 96" long, but it should be recognized that other lengths may be used in other forms. Further, the gazebo wedge strip 152 is preferentially made from a material that makes it easy to cut the gazebo wedge strip 152 to desired lengths.

Figure 22:
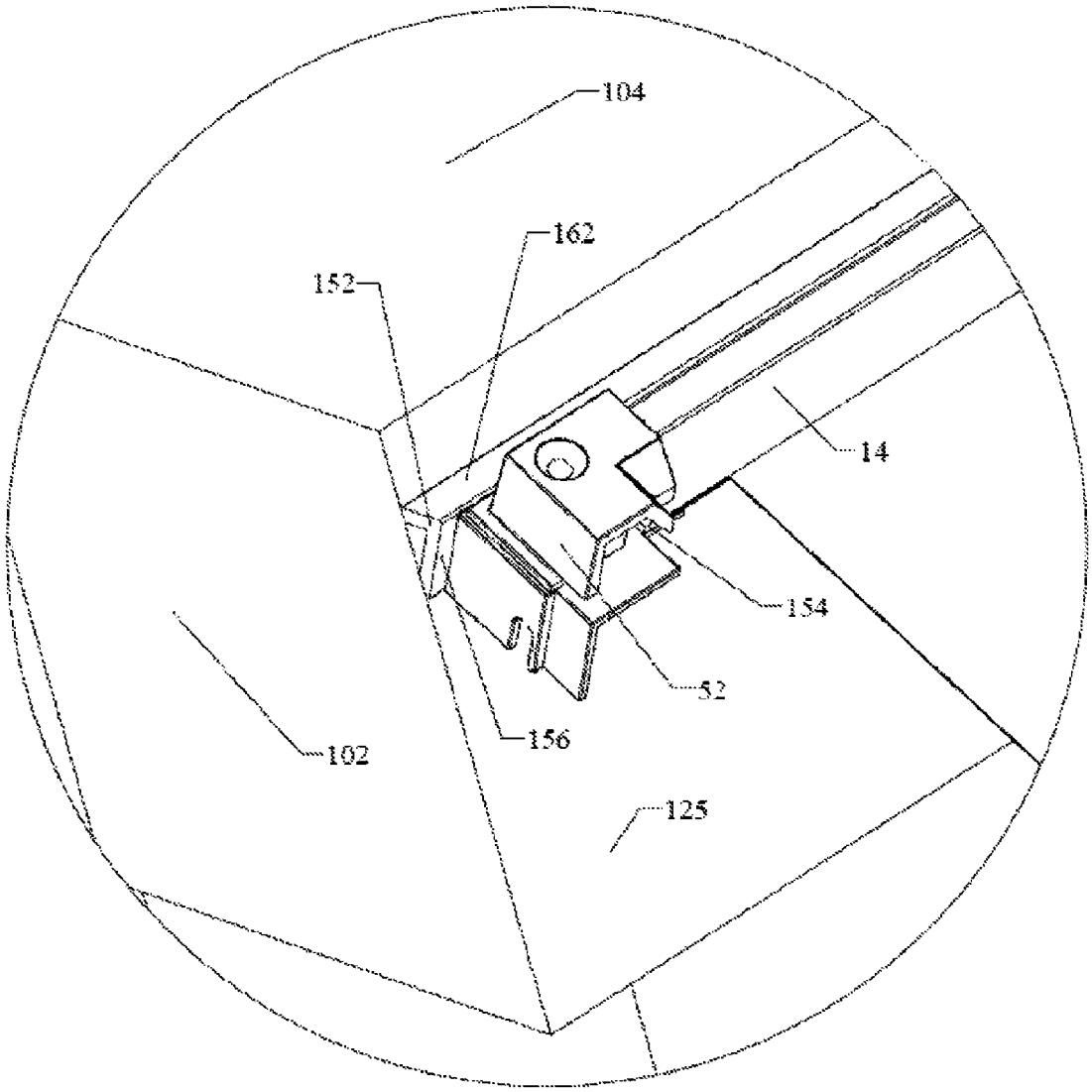
FIG. 22 illustrates further components of a representative gazebo screen installation system.

Referring to FIG. 22, in yet another form, a plinth 52 may be used in the corners of the screen assemblies 151 that are installed in the gazebo 100. As with the previous forms, the plinths 52 are used to help further secure the trim molds 14 to the gazebo screen frame 154. All features of the plinth 52 are the same as previously discussed and for the sake of brevity, a detailed discussion is not necessary for the sake of brevity. It should be noted that the horizontal components of the gazebo screen assemblies 151 may be formed using the same materials and components described with previous forms disclosed herein.

Further, in some forms, the gazebo screen frame 154 and backing wedge strip 152 may be formed as one integral piece instead of as separate pieces as disclosed herein. This could also be accomplished by changing the angle of the wedge portion 158 relative to the trim portion 160 from 90 degrees as previously described to 60 degrees for a hexagonal gazebo or 45 degrees for an octagonal gazebo or another angle corresponding to a gazebo with a different number of sides.

While the invention has been illustrated and described in detail in the drawings and foregoing description, the same is to be considered as illustrative and not restrictive in character, it being understood that only certain exemplary embodiments have been shown and described. Those skilled in the art will appreciate that many modifications are possible in the example embodiments without materially departing from this invention. Accordingly, all such modifications are intended to be included within the scope of this disclosure as defined in the following claims.

In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A gazebo screen installation system, comprising:

a gazebo screen frame having a wedge portion and a trim portion, wherein said trim portion includes a mounting rib extending upwardly from an upper surface of the trim portion and said wedge portion extends downwardly from said trim portion; and a backing wedge strip having an angled surface and a mounting surface, wherein said angled surface is formed in relation to said mounting surface such that a right angle forming angle of the backing wedge strip positions said wedge portion of said gazebo screen frame perpendicular to a screen material stretched between at least two gazebo screen frames, wherein said mounting rib is configured to resist penetration of said screen; and wherein an outer surface located along a length of said wedge portion is configured to abut an exterior surface located along a length of said angled surface.

2. The gazebo screen installation system of claim 1, wherein said wedge portion, said trim portion, and said backing wedge strip are formed as a single integral component.

3. The gazebo screen installation system of claim 1, wherein a distal end of said mounting rib includes a bead.

4. The gazebo screen installation system of claim 1, wherein a proximal end of said angled surface includes a rib extending away from said angled surface.

5. The gazebo screen installation system of claim 1, further comprising a trim mold configured to be positioned over said mounting rib to secure said screen material in a channel opening of said mounting rib.

6. The gazebo screen installation system of claim 1, wherein a proximal end of said wedge strip includes a wedge receiving slot sized and configured to receive said wedge portion of said screen frame.

7. The gazebo screen installation system of claim 6, wherein said right angle forming angle comprises about 30 degrees.

8. The gazebo screen installation system oaf claim 6, wherein said right angle forming angle comprises about 22.5 degrees.

9. The gazebo screen installation system of claim 1, wherein said right angle forming angle is determined as a function of a number of sides of said gazebo.

10. A gazebo screen installation system, comprising:

a gazebo screen frame having a wedge portion and a trim portion, wherein said wedge portion extends below said trim portion, wherein an upper surface of said trim portion includes a mounting rib extending upwardly from said trim portion, wherein an upper end of said mounting rib includes a bead;

a trim mold having a channel opening therein sized and configured to releaseably receive said mounting rib, wherein a screen material is operable to be positioned within said channel opening of said trim mold secures said screen material to said mounting rib; and a backing wedge strip having an angled surface and a mounting surface, wherein said angled surface has a right angle forming angle in relation to said mounting surface and a first vertical support member of a gazebo to which said backing wedge strip is to be attached, wherein said right angle forming angle comprises an angle operable to position said wedge portion of said screen frames perpendicular to said screen material once stretched between opposing gazebo screen frames, wherein said right angle forming angle comprises an acute angle, and wherein said bead is configured to resist penetration of said screen.

11. The gazebo screen installation system of claim 10, wherein said wedge portion is oriented at a 90 degree angle relative to said trim portion.

12. The gazebo screen installation system of claim 10, wherein said angle comprises about 30 degrees.

13. The gazebo screen installation system of claim 10, wherein said angle comprises about 22.5 degrees.

14. The gazebo screen installation system of claim 10, wherein a proximal end of said backing wedge strip includes a rib extending away from an upper surface of said angled surface.

15. The gazebo screen installation system of claim 14, wherein an end of said wedge portion of said of said gazebo screen frame is positioned against said rib.

16. A gazebo frame assembly for a gazebo, comprising:

a pair of opposing horizontal screen frames and a pair of opposing vertical screen frames, wherein each of said vertical screen frames includes a backing strip wedge portion, wherein each of said backing strip wedge portions have an angled surface configured to orient said vertical screen frames in an opening defined by a pair of opposing vertical support members of said gazebo having different angular configurations such that said vertical screen frames are aligned substantially parallel to one another, wherein an outer surface located along a length of said wedge portion is configured to abut an exterior surface located along a length of said angled surface; and a screen material positioned between said pair of opposing horizontal screen frames and said opposing vertical screen frames.

17. The gazebo screen installation system of claim 16, wherein said angled surface has an angle of about 30 degrees relative to an interior side of said vertical support members.

18. The gazebo screen assembly of claim 16, wherein said angled surface has an angle of about 22.5 degrees relative to an interior side of said vertical support members.

* * * * *